US009828783B1

(12) United States Patent
Farrier et al.

(10) Patent No.: US 9,828,783 B1
(45) **Date of Patent: *Nov. 28, 2017**

(54) FLUSH MOUNTED VINYL NOZZLE ASSEMBLY AND METHODS OF USE

(71) Applicant: GSG Holdings, Inc., Chandler, AZ (US)

(72) Inventors: M. Shaun Farrier, Peoria, AZ (US); Steve Sharp, Phoenix, AZ (US)

(73) Assignee: GSG Holdings, Inc., Chandler, AZ (US)

( * ) Notice: Subject to any disclaimer, the term of this patent is extended or adjusted under 35 U.S.C. 154(b) by 91 days.

This patent is subject to a terminal disclaimer.

(21) Appl. No.: 14/805,395

(22) Filed: Jul. 21, 2015

Related U.S. Application Data

(63) Continuation of application No. 14/495,162, filed on Sep. 24, 2014.

(60) Provisional application No. 61/883,889, filed on Sep. 27, 2013.

(51) Int. Cl.
*E04H 4/16* (2006.01)
*E04H 4/12* (2006.01)
*B05B 1/00* (2006.01)

(52) U.S. Cl.
CPC ..... *E04H 4/1209* (2013.01); *B05B 1/00* (2013.01)

(58) Field of Classification Search
CPC .. E04H 4/14; E04H 4/16; E04H 4/169; E04H 4/1209; B05B 1/00
USPC ..... 4/490, 492, 507, 541.6
See application file for complete search history.

(56) References Cited

U.S. PATENT DOCUMENTS 3,749,424 A * 7/1973 Greene ..... F16L 47/28 285/139.1
4,561,134 A * 12/1985 Mathews ..... E04H 4/12 4/496
4,919,338 A * 4/1990 Junk ..... B05B 15/067 239/587.4
5,408,706 A * 4/1995 Barnes ..... E03F 5/0407 210/163
2008/0148500 A1* 6/2008 Ribeiro ..... E04H 4/169 15/1.7
2012/0174312 A1* 7/2012 Loyd ..... B05B 1/3026 4/541.6

* cited by examiner

*Primary Examiner* — J. Casimer Jacyna
(74) *Attorney, Agent, or Firm* — Booth Udall Fuller, PLC

(57) ABSTRACT

A pool nozzle assembly includes a body, a clamp ring, a plurality of screws, a cover ring, and a nozzle. The body includes a body rim having a plurality of screw receivers and a female threaded portion. The clamp ring is removably coupled to the body and couples a vinyl liner between the clamp ring and the body. The clamp ring includes an inner rim and an outer rim. The plurality of screws removably couple the clamp ring to the body. The cover ring includes a cover rim and a male threaded portion threadedly coupled to the female threaded portion. The cover rim covers the plurality of screws and is substantially planar with the outer rim. The nozzle is removably coupled to the base of the body such that a top end of the nozzle is substantially planar with outer rim and the cover rim.

12 Claims, 14 Drawing Sheets

FLUSH MOUNTED VINYL NOZZLE ASSEMBLY AND METHODS OF USE

CROSS REFERENCE TO RELATED APPLICATIONS

This application is a continuation-in-part application of the earlier U.S. Utility Patent Application to Farrier et al. entitled "Flush Mounted Vinyl Nozzle Assembly and Methods of Use," application Ser. No. 14/495,162, filed Sep. 24, 2014, now pending, which application claims the benefit of the filing date of U.S. Provisional Patent Application 61/883,889, entitled "Flush Mounted Vinyl Nozzle Body and Assembly" to Sharp which was filed on Sep. 27, 2013, the disclosures of all of which are hereby incorporated by reference.

BACKGROUND

1. Technical Field

Aspects of this document relate generally to pool nozzle assemblies.

2. Background Art

Nozzle assemblies are often used in pools and spas to mount a nozzle to the surface a pool. Particular nozzle assemblies are designed for pools with a vinyl liner on the pool surface. Conventional nozzle assemblies require one or more screws to hold down a clamp ring, which then squeezes the liner between two gaskets and a flange on the nozzle body to create a watertight assembly. The screws of these assemblies, however, are visible and are considered by some to be unsightly. Furthermore, the clamp ring is approximately ⅜" above the pool surface, a height that is objectionable to some pool owners. Conventional pool nozzle assemblies also require users to cut a hole in the vinyl liner before anything secures the vinyl liner. This is problematic because it can lead to the vinyl liner slipping out of the nozzle assembly. Conventional pool nozzle assemblies are also configured in a way that a user may inadvertently unscrew the whole assembly when merely trying to remove cleaning nozzle.

SUMMARY

According to one aspect, a pool nozzle assembly comprises a body comprising a first coupling portion, a seal ring, a clamp ring, and a cover ring. The seal ring is coupled to a body rim of the body and comprising an integrated seal. The clamp ring is removably and adjustably coupled to the body and configured to couple a vinyl liner between the clamp ring and the seal ring and position the vinyl liner below an outer plane of the body. The cover ring comprises a second coupling portion directly and mechanically engaged with the first coupling portion.

Various implementations and embodiments may comprise one or more of the following. The seal ring may comprise at least one indexing guide engaged with at least one key on the body. The clamp ring may comprise a recessed inner rim removably coupled to the body below the outer plane of the body and an outer rim positioned above the outer plane of the body. The cover ring may comprise a cover rim that covers the inner rim and is substantially planar with the outer rim of the clamp ring. The first coupling portion may comprise a female threaded portion and the second coupling portion may comprise a male threaded portion threadedly coupled to the female threaded portion. The body may further comprise a body rim comprising a plurality of screw receivers, the inner rim comprises a plurality of screw holes aligned with the plurality of screw receivers, the seal ring comprises a plurality of screw holes aligned with the plurality of screw receivers, and the clamp ring and the seal ring are removably and adjustably coupled to the body with a plurality of screws extending through the screw holes of the seal ring and the screw holes of the inner rim and into the screw receivers. The cover ring may comprise at least two ribs on an inner portion of the cover ring, and the pool nozzle assembly further comprises an installation tool comprising: a base sized to fit within the outer rim of the clamp ring and interface with the inner rim of the clamp ring; at least one opposing screw apertures positioned to align with at least one of the plurality of screw holes on the clamp ring when the base of the installation tool is positioned within the outer rim of the clamp ring; a head sized to fit within the inner portion of the cover ring and comprising at least two slots sized and positioned to engage with the at least two ribs on the inner portion of the cover ring when the head of the installation tool is positioned within the inner portion of the cover ring; and one or more handles. The body may further comprise a base having a plurality of bayonets and a plurality of keys, and the clamp ring may comprise a plurality of key slots engaged with the plurality of keys. A nozzle removably coupled to the base of the body such that a top end of the nozzle is substantially planar with the outer rim and the cover rim.

According to another aspect, a pool nozzle assembly comprises a body, a seal ring, a clamp ring, a cover ring, and a nozzle. The body comprises a body rim positioned below an outer plane of the body. The seal ring is coupled to the body adjacent the body rim. The clamp ring is coupled to the body and configured to couple a vinyl liner between the clamp ring and the seal ring. The cover ring is directly coupled to the body and comprising a cover rim. The nozzle is removably coupled to the body such that a top end of the nozzle is substantially planar with the cover rim of the cover ring.

Various implementations and embodiments may comprise one or more of the following. The body may comprise a base configured to couple to a water line coupling, a body rim comprising a plurality of screw receivers, and a first coupling portion between the body rim and the base. The seal ring may comprise and integrated seal a plurality of screw holes extending through the seal ring and aligned with the plurality of screw receivers of the body. The clamp ring may comprise a recessed inner rim, a plurality of screw holes extending through the recessed inner rim and aligned with the plurality of screw receivers of the body, and an outer rim, a plurality of screws extending through the plurality of screw holes into the plurality of screw receivers to removably couple the clamp ring and the seal ring to the body. The cover ring may comprise a second coupling portion directly and mechanically engaged with the first coupling portion of the body, wherein the cover rim of the cover ring covers the plurality of screws and is substantially planar with the outer rim of the clamp ring. The nozzle may be removably coupled to the base of the body such that the top end of the nozzle is substantially planar with both the outer rim and the cover rim. The seal ring may comprise at least one indexing guide engaged with at least one key on the body. The base may comprise one or more bayonets that engage with one or bayonets on the nozzle to removably couple the nozzle to the body and one or more keys, and the clamp ring comprises one or more key slots aligned with and interfacing the one or more keys. The cover ring may comprise at least two ribs on an inner portion of the cover ring, and the pool nozzle assembly may comprise an installation tool comprising: a base sized to fit within the outer rim of the clamp ring and interface with the inner rim of the clamp ring; one or more opposing screw apertures positioned to align with one or more of the plurality of screw holes on the clamp ring when the base of the installation tool is positioned within the outer rim of the clamp ring; a head sized to fit within the inner portion of the cover ring and comprising at least two slots sized and positioned to engage with the at least two ribs on the inner portion of the cover ring when the head of the installation tool is positioned within the inner portion of the cover ring; and one or more handles.

According to another aspect, a method of mounting a pool nozzle assembly to a pool having a vinyl liner comprise coupling a body to a water line such that an outer ring of the body is substantially flush with a pool base; positioning a seal ring within the outer ring of the body; adjustably coupling a recessed inner rim of a clamp ring to a body rim of the body until a vinyl liner is held between the inner rim and the seal ring and between an outer rim of the clamp ring and the inner ring of the body; adjustably coupling a cover ring to the body by directly and mechanically engaging a first coupling portion of the body with a second coupling portion of the cover ring until a cover rim of the cover ring is substantially planar with the outer rim of the clamp ring and covers the inner rim of the clamp ring; inserting a nozzle through the cover ring, the clamp ring, and the seal ring and into the body until a top end of the nozzle is substantially planar with the cover rim and the outer rim; and coupling the nozzle to a base of the body.

Various implementations and embodiments may comprise one or more of the following. Adjustably coupling an inner rim of a clamp ring to a body rim of the body may comprise adjustably coupling the inner rim of the clamp ring to the body rim of the body with a plurality of screws inserted through a plurality of screw holes on the inner rim of the clamp ring and into a plurality of screw receivers on the body rim. Inserting a base of an installation tool within the outer rim of the clamp ring. Aligning at least one or more screw apertures with one or more screw holes of the plurality of screw holes on the clamp ring. Applying a uniform pressure to the clamp ring with the base of the installation tool by pressing the installation tool towards the clamp ring. Adjustably coupling a cover ring to the body by directly and mechanically engaging a first coupling portion of the body with a second coupling portion of the body may comprise threadedly coupling a female threaded portion of the body with a male threaded portion of the cover ring. Aligning two or more slots on a head of the installation tool with two or more ribs on an inner portion of the cover ring and inserting the head of the installation tool into the cover ring such that the two or more slots are engaged with the two or more ribs, wherein threadedly coupling the female threaded portion of the body with the male threaded portion of the cover ring may comprise threadedly coupling the female threaded portion of the body with the male threaded portion of the cover ring by rotating the installation tool. Coupling the nozzle to the base of the body may comprise coupling the nozzle to the base of the body by engaging bayonets on the base of the body with bayonets on the nozzle. Aligning the clamp ring with the body by inserting one or more keys on the body into one or more key slots on the clamp ring and aligning the seal ring with the body by inserting the one or more keys on the body into one or indexing guides on the clamp ring.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

The invention will hereinafter be described in conjunction with the appended drawings, where like designations denote like elements, and.

DESCRIPTION

This disclosure, its aspects and implementations, are not limited to the specific components or assembly procedures disclosed herein. Many additional components and assembly procedures known in the art consistent with the intended pool nozzle assembly and/or assembly procedures for a pool nozzle assembly will become apparent for use with implementations of pool nozzle assemblies from this disclosure. Accordingly, for example, although particular cleaning nozzles, screws, bodies, clamp rings, and cover rings are disclosed, such cleaning nozzles, screws, and the like and implementing components may comprise any shape, size, style, type, model, version, measurement, concentration, material, quantity, and/or the like as is known in the art for such cleaning nozzles, screws, bodies, clamp rings, and cover rings and implementing components, consistent with the intended operation of pool nozzle assembly.

Embodiments of a flush mounted vinyl pool nozzle assembly contemplated herein are advantageous to conventional pool nozzle assemblies known in the art for various reasons which will become evident upon review of this disclosure. For example, according to some aspects, a nozzle assembly may include a cleaning nozzle having a top end that is substantially planar with a clamp ring and a cover ring. The clamp ring and cover ring are substantially flush with the vinyl liner of a pool, having only an insignificant and nearly unobservable raise above the vinyl liner of the pool (see FIG. 2). This results in a nozzle assembly that is less likely to cause harm to a pool user and/or less likely to be damaged by a pool user because the nozzle assembly does not extend significantly above the vinyl liner of the pool.

One or more embodiments of a flush mounted vinyl pool nozzle assembly contemplated as part of this disclosure are also advantageous to conventional pool nozzle assemblies because an installer may secure or anchor the vinyl liner to the body of the nozzle assembly prior to cutting the vinyl liner in anticipation of insertion of the cleaning nozzle. Because an installer is able to anchor the vinyl liner to the nozzle assembly before cutting the vinyl liner in anticipation of inserting the cleaning nozzle through the vinyl liner, the vinyl liner is unlikely to slip out from the nozzle assembly.

One or more embodiments of a flush mounted vinyl pool nozzle assembly contemplated as part of this disclosure are also advantageous to conventional pool nozzle assemblies because removal of a cleaning nozzle is unlikely to unscrew or rotate the hole nozzle assembly. For example, in some non-limiting embodiments, the cleaning nozzle is couple to a body with bayonets. By rotating the cleaning nozzle to disengage the bayonets, the body and clamp ring are unaffected by removal and replacement of the cleaning nozzle.

Figure 1:
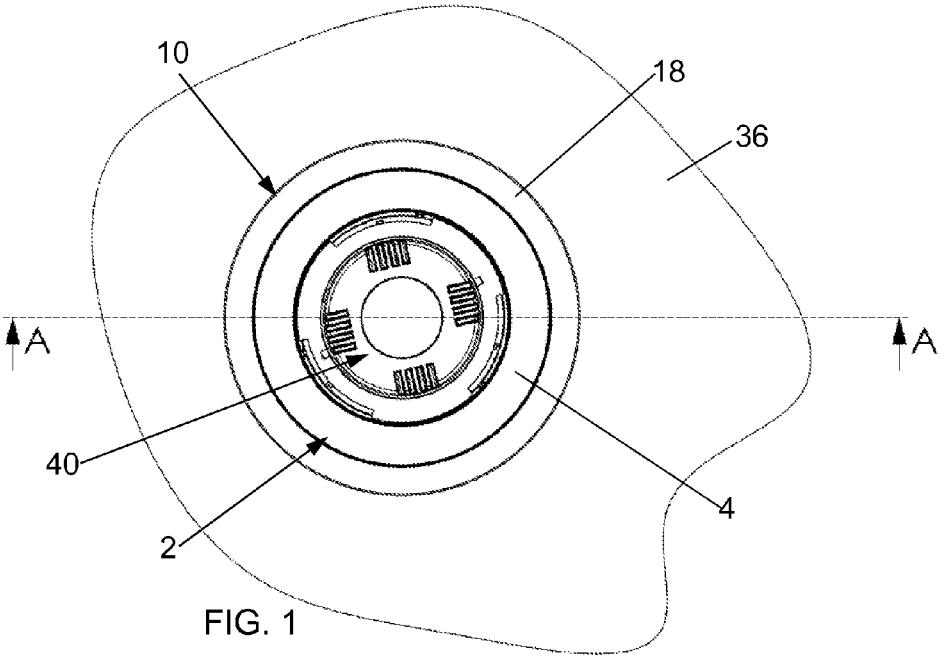
FIG. 1 is a top view of a pool nozzle assembly mounted in a vinyl lined pool.

FIG. 1 depicts a top view of a non-limiting embodiment of a pool nozzle assembly mounted to a pool having a vinyl liner 36. According to some aspects, a pool nozzle assembly comprises a cleaning nozzle 40, a cover ring 2, a clamp ring 10, and a body 20 (not visible in FIG. 1). When installed into the pool, typically only a top end 46 of the cleaning nozzle, a cover rim 4 of the cover ring 2, and an outer rim 18 of the clamp ring 10 are visible. Each of the top end 46 of the cleaning nozzle, the cover rim 4, and the outer rim 18 are typically substantially planar with one another. More particularly, each of the top end 46 of the cleaning nozzle, the cover rim 4, and the outer rim 18 are typically only raised above the vinyl liner 36 in an insignificant amount, as depicted in FIGS. 2 and 3.

Figure 2:
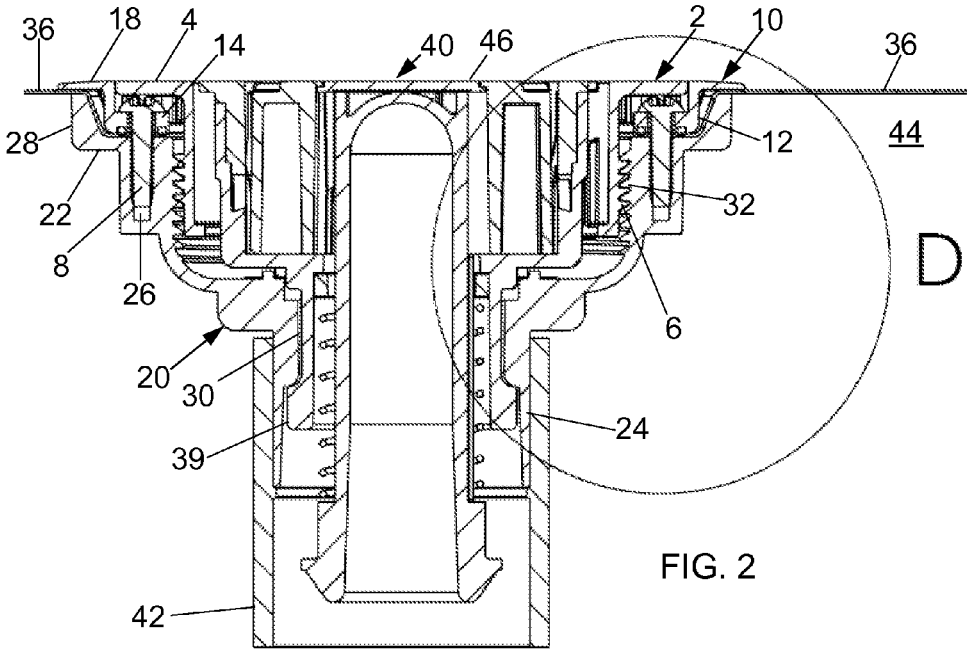
FIG. 2 is a cross-sectional view of a pool nozzle assembly mounted in a vinyl lined pool taken along line A-A of FIG. 1.
Figure 3:
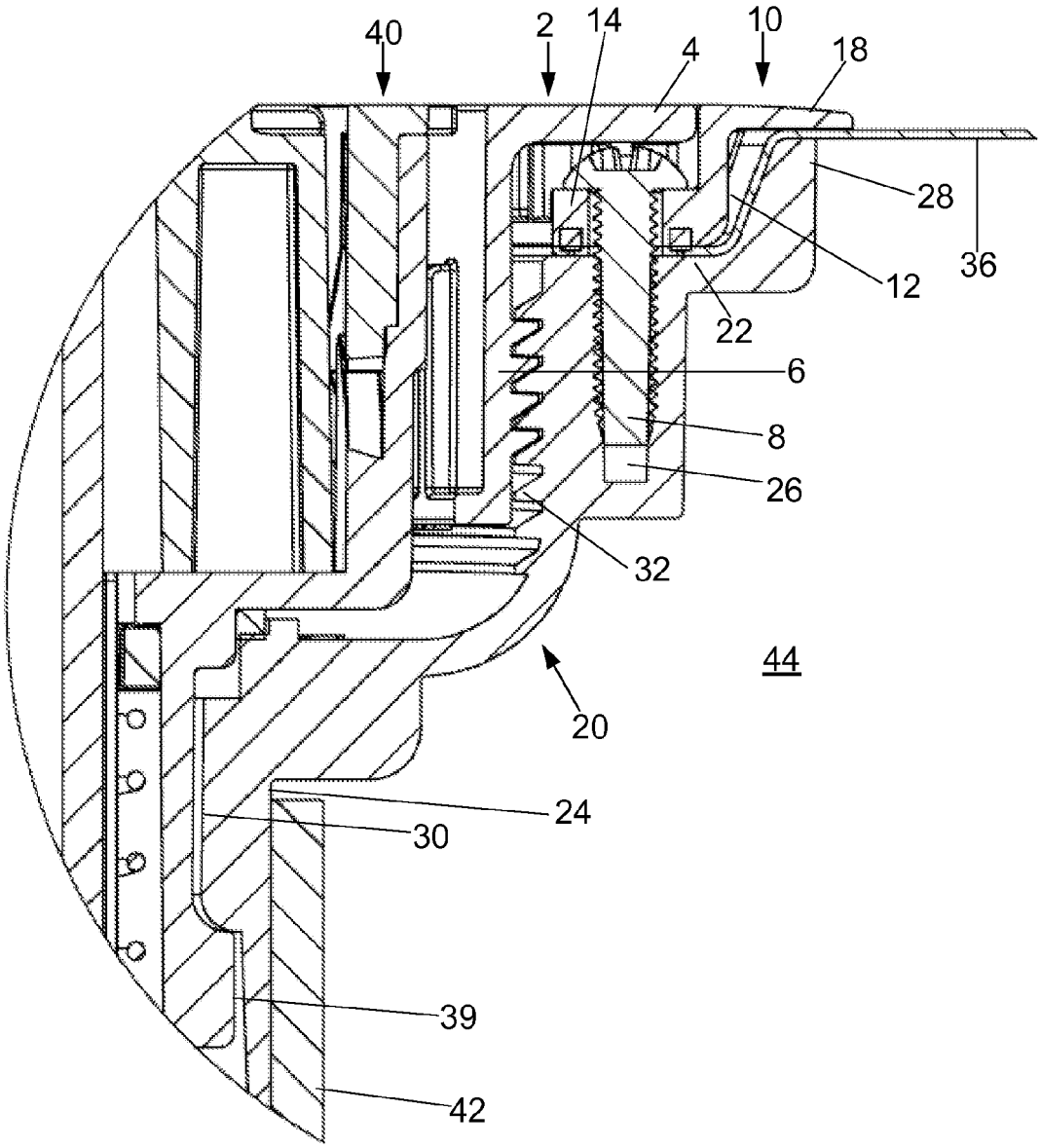
FIG. 3 is an enlarged view of the area encompassed by circle D in FIG. 2.

FIG. 2 depicts a cross-sectional view of a non-limiting embodiment of a pool nozzle assembly taken along line A-A of FIG. 1. According to some aspects of a nozzle assembly, a body 20 of the nozzle assembly is coupled to a water line with a line coupling 42. The line coupling 42 may comprise any coupling known in the art to couple a nozzle assembly to a water line. More particularly, the body 20 may comprise a base 24 configured to slide within the line coupling 42 to couple to the line coupling 42.

Figure 4:
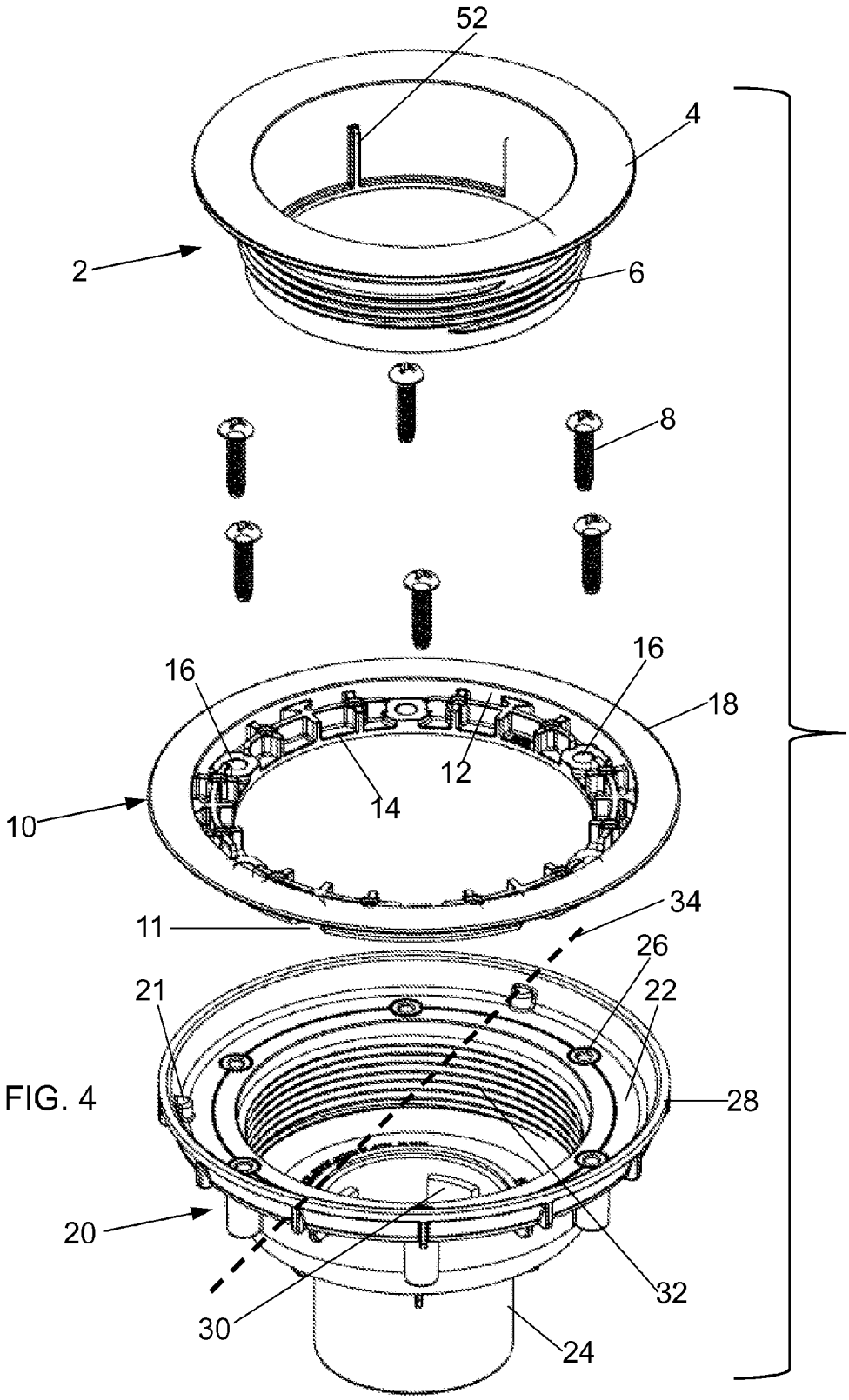
FIG. 4 is an exploded view of a pool nozzle assembly.

One or more embodiments of a body 20 of a nozzle assembly further comprise a body rim 22. The body rim 22 is typically recessed or below an outer plane 34 of the body 20 and configured to removably couple to a clamp ring 10. The outer plane 34 of the body 20 is typically formed by an outer ring 28 of the nozzle assembly. FIGS. 2 and 3 depict non-limiting embodiments of a clamp ring 10 removably coupled to the body 20 at the body rim 22, and FIG. 4 depicts an exploded view of a non-limiting embodiment of a nozzle assembly that provides a perspective view of a body rim 22. As depicted in FIGS. 2 and 3, the body rim 22 is typically recessed sufficiently that the recessed inner rim 14 of the clamp ring 10 is positioned below the outer plane 34 and at least a portion of the outer ring 28 of the body 20.

Embodiments of the body 20 are typically configured to removably couple to clamp ring 10 with any removable coupling mechanism known in the art, such as but not limited to screws, threaded coupling, pins, and the like. In the non-limiting embodiment depicted in FIGS. 2-4, the body rim comprises a plurality of screw receivers 26 each configured to receive a screw 8 to adjustably and removably couple the clamp ring 10 to the body 20. In one or more embodiments, a body 20 further comprises at least one key 21 corresponding to a key slot 11 on the clamp ring 10 to allow a user to properly align the clamp ring 10 with the body 20 before coupling the clamp ring 10 to the body 20. The key 21 typically comprises a protrusion shaped complementary to the key slot 11. In other embodiments, the key 21 may be positioned on the clamp ring 10 and the key slot 11 positioned on the body 20.

One or more embodiments of a body 20 of a nozzle assembly further comprise a first coupling portion. The first coupling may be positioned between the body rim 22 and the base 24 and is configured to mechanically and directly couple the body 20 to the cover 2. The first coupling portion may comprise any coupling known in the art configured to mechanically and directly couple the body 20 to the cover 2, such as but not limited to threaded coupling, screws, and the like. In the non-limiting embodiment depicted in FIGS. 2-4, the first coupling portion comprises a female threaded portion 32 configured to threadedly couple to a male threaded portion 6 on the cover ring 2 to mechanically and directly couple the cover ring 2 to the body 20. The female threaded portion 32, or any other coupling utilized, is positioned to allow a user to coupled the cover ring 2 such that a cover rim 4 of the cover ring 2 is substantially planar with the outer rim 18 of the clamp ring 10.

One or more embodiments of a body 20 of a nozzle assembly further comprise one or more bayonets 30 on an inner surface of the base 24. The bayonets 30 of the body 20 are spaced and sized to allow insertion of a portion of the nozzle 40 into the base 24. The bayonets 30 of the body 20 are further spaced and sized to engage with bayonets 39 on the nozzle 40 upon rotation of the nozzle to removably couple the nozzle 40 to the body 20. FIGS. 3 and 4 depict non-limiting embodiments of bayonets 30 of the body 20 engaged with bayonets 39 of the nozzle 40 to removably couple the nozzle 40 to the body 20. FIG. 4 depicts a perspective view of a portion of two bayonets 30 on an inner surface of the base 24.

Various embodiments of a pool nozzle assembly contemplated in this disclosure further comprise a clamp ring 10 removably and adjustably coupled to the body 20. According to some aspects, the clamp ring 10 holds or pinches the vinyl liner 36 between the clamp ring 10 and the body 20. Because the clamp ring 10 is adjustably coupled to the body 20, the nozzle assembly may be utilized with varying thicknesses of vinyl liners 36. As used herein, adjustably coupled refers to the ability of a user to adjust the distance between the clamp ring 10 and the body 20 to adjust for different thicknesses of vinyl liners 36.

The exploded view of a non-limiting embodiment of a nozzle assembly in FIG. 4 provides a perspective view of a clamp ring 10. According to some aspects, a clamp ring 10 comprises an outer rim 18 and a recessed inner rim 14. Typically, a sidewall 12 is positioned between the outer rim 18 and the recessed inner rim 14. A clamp ring 10 may also comprise a plurality of ribs on the recessed inner rim 14 and one or more key slots 11 corresponding to the one or more keys 21 of the body 20.

As noted above, the clamp ring 10 is configured to removably adjustably couple to the body 20. According to some aspects, such as the non-limiting embodiment depicted in FIGS. 2-4, the clamp ring 10 removably couples to the body 20 with a plurality of screws 8 that extend through a plurality of screw holes 16 on the inner rim of the clamp ring 10 and into the screw receivers 26 on the body rim 22 of the body 20. By tightening or loosening the screws 8, a user may adjust the coupling of the clamp ring 10 to the body 20 to the particular thickness of the vinyl liner 36. In other embodiments, the clamp ring 10 may be removably and adjustably coupled to the body 20 through any mechanism known in the art, such as but not limited to threaded coupling and/or pins.

FIGS. 2 and 3 depicts a cross-sectional view of a clamp ring 10 holding a vinyl liner 36 between the clamp ring 10 and the body 20. According to some aspects, the vinyl liner is held or pinched between the body rim 22 and the recessed inner rim 14 and/or between the outer ring 28 and the outer rim 18 when the clamp ring 10 is coupled to the body 20. The screws 8 also extend through the screw holes 16 of the clamp ring 10, the vinyl liner 36, and into the screw receivers 26. When properly coupled together, the recessed inner rim 14 is typically positioned within the body 20 below the outer plane 34 and at least partially below the outer ring 28. The head of each screw 8 is typically positioned below the plane of the outer rim 18 of the clamp ring 10 to allow for proper coupling of the cover ring 2 to the body 20.

One or more embodiments of a nozzle assembly further comprise a cover ring 2. The cover ring 2 is configured to cover the screws 8 and the recessed inner rim 14 of the clamp ring 10. This inhibits undesired and accidental loosening of the clamp ring 10, as well as prevents the hazard of exposed screws and uneven plastic on the bottom surface of a pool. According to some aspects, the cover ring 2 comprises a second coupling portion and a cover rim 4. The second coupling portion may comprise any coupling known in the art configured to mechanically engage and directly couple to the first coupling portion of the body 20. In the non-limiting embodiment of FIGS. 2-4, the second coupling portion comprises a male threaded portion 6 that mechanically and directly engages with the female threaded portion 32 of the body 20 to removably and adjustably couple the cover ring 2 to the body 20. Typically, the user may threadedly couple the cover ring 2 to the body 20 until the cover rim 4 is substantially planar with the outer rim 18 of the clamp ring 10 (shown in FIGS. 2 and 3).

One or more embodiments of a nozzle assembly further comprise a seal ring 60. FIGS. 6-11 depict various views of a non-limiting embodiment of a seal ring 60 positioned within a nozzle assembly. The seal ring 60 placed in the housing beneath the vinyl liner 36 further assists in keeping water from seeping into the area beneath the liner. A seal ring 60 may provide protection against leakage, is easily replaceable, and no sealant is necessary. Any leaking above the liner is irrelevant because it would stay within the body of the water in the pool. A seal ring 60 may not be required in all embodiments of a nozzle assembly.

FIGS. 12A-D depict various views of a non-limiting embodiment of a seal ring 60. A seal ring 60 is configured to seat on a body rim 22 of a body 50 and form an improved seal between the vinyl liner 36 and the body 50 of the nozzle assembly. According to some aspects, a seal ring 60 comprises an integrated seal 66 on an outer perimeter of the seal ring 60. A seal ring 60 may further comprise one or more indexing guides 62 positioned to align with the keys 21 on the body 50 and prevent the sealing ring 60 from rotating within the body 50. Furthermore, a seal ring 60 may also comprise one or more screw holes 64 extending through the seal ring 60 and positioned to align with the one or more screw holes 16 on the inner rim 14 of the clamp ring 10 and the one or more screw receivers 26 of the body 50. According to some aspects, a seal ring 60 is replaceable and reversible, having the same configuration on the top and the bottom of the seal ring 60.

Unless otherwise stated, a nozzle assembly that includes a seal ring 60 may comprise any of the elements described elsewhere in this document, such as but not limited to a cleaning nozzle 40, a cover ring 2, a clamp ring 10, and a body 50. In the non-limiting embodiment depicted in FIGS. 6-11, a body 50 comprises a deeper outer rim 58 than the body 40 previously described. This deeper outer rim 58 allows for seating of both the seal ring 60 and the recessed inner rim 14 of the clamp ring 10 below the outer plane 34 of the body 50. In other embodiments, a seal ring 60 may be sized to fit within a body 40 described elsewhere in this document or otherwise known in the art.

Figure 5:
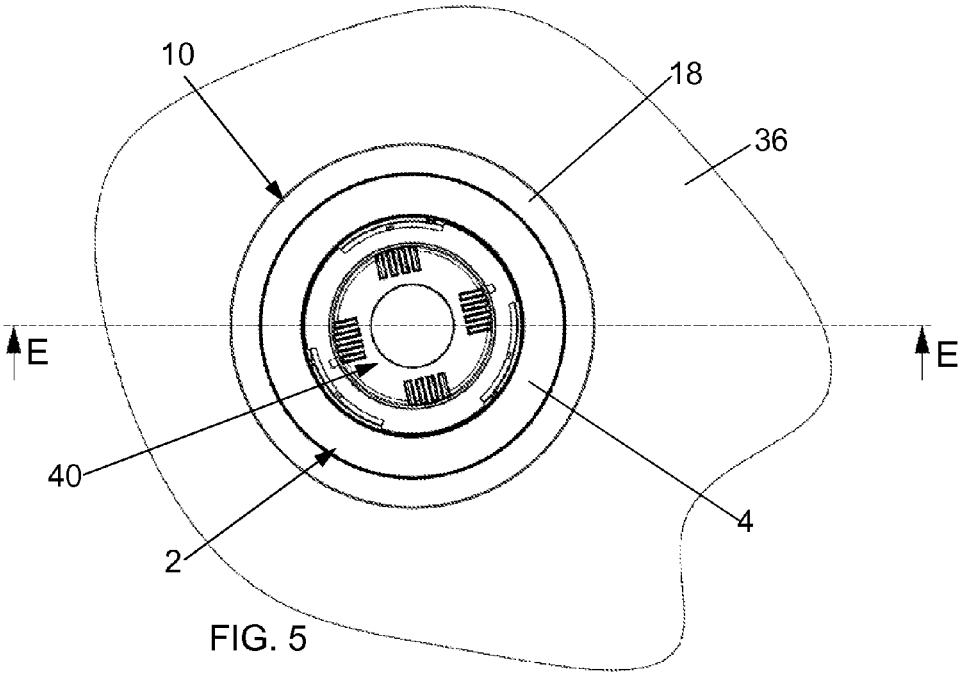
FIG. 5 is a top view of a second embodiment of a pool nozzle assembly mounted in a vinyl lined pool.
Figure 6:
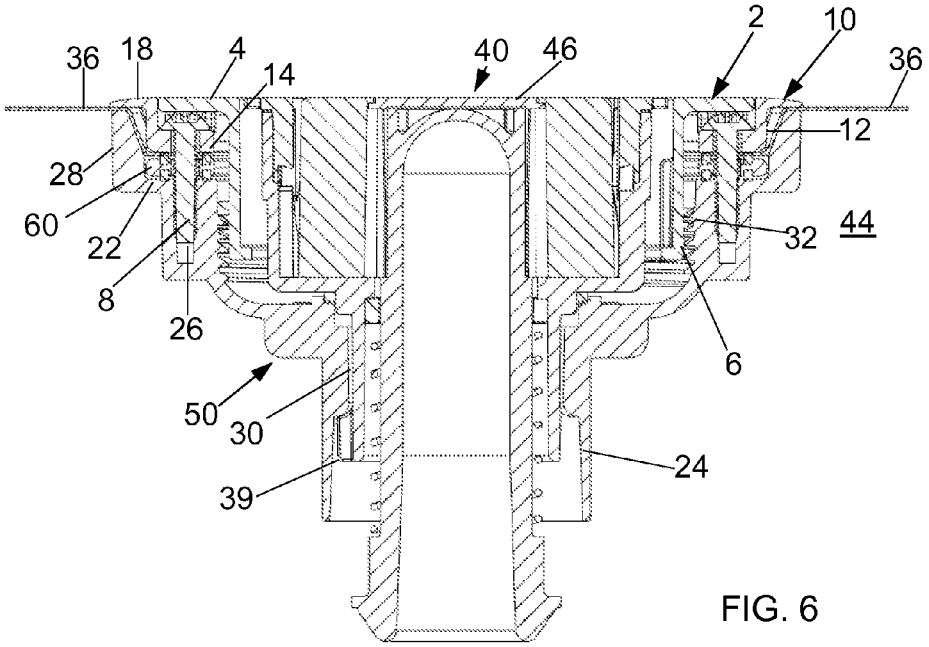
FIG. 6 is a cross-sectional view of a second embodiment of a pool nozzle assembly mounted in a vinyl lined pool taken along line E-E of FIG. 5.
Figure 7:
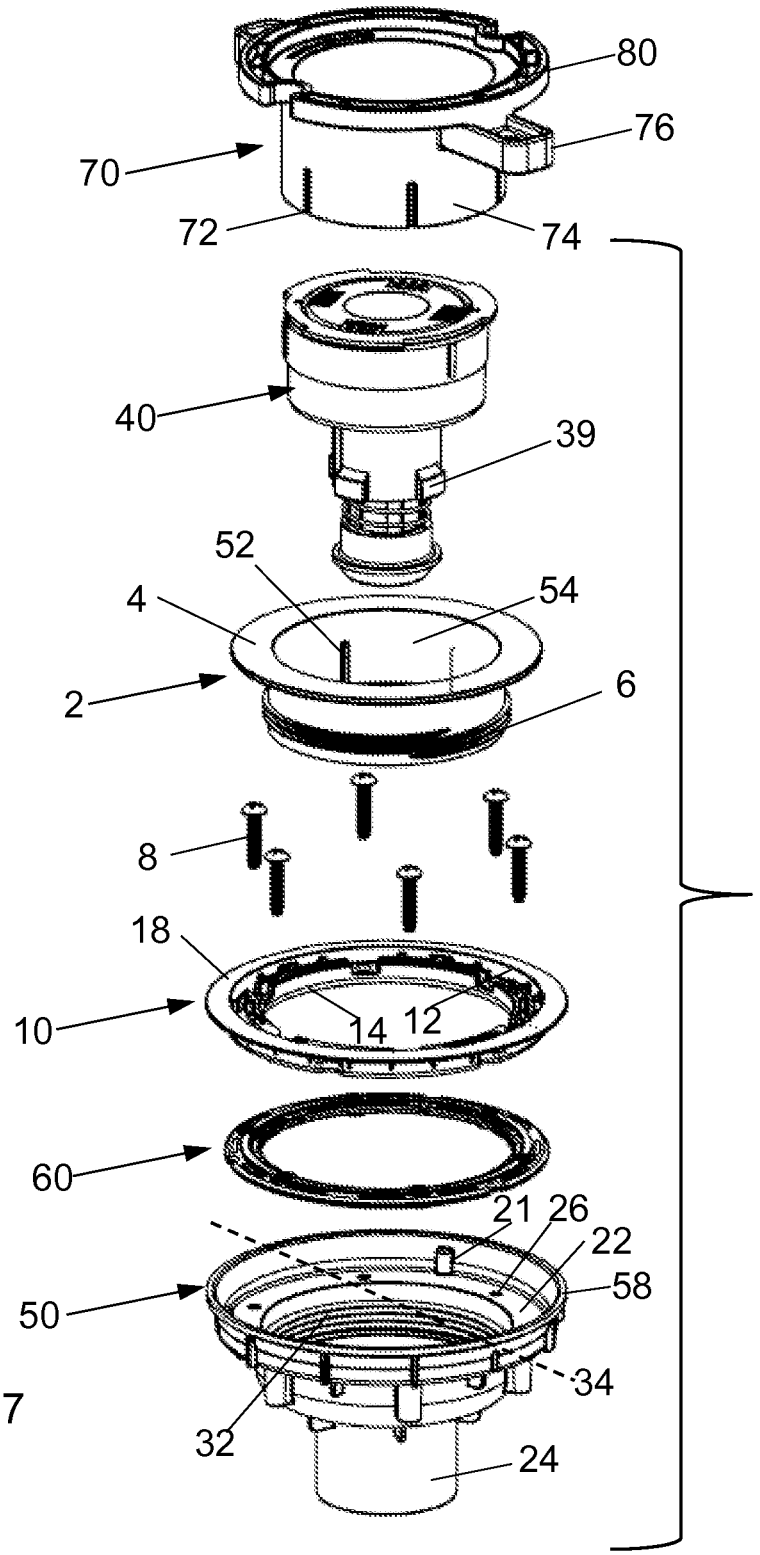
FIG. 7 is an exploded view of a second embodiment of pool nozzle assembly with an installation tool.

More specifically, FIG. 5 depicts a top view of a nozzle assembly that includes a seal ring 60 mounted in a vinyl lined pool, although the seal ring 60 is obscured from view by the clamp ring 10 and the cover ring 2. FIG. 6 is a cross-sectional view of a nozzle assembly taken along lined E-E of FIG. 5 and depicts a non-limiting placement of a seal ring 60 in a nozzle assembly. By aligning the indexing guides 62 of the seal ring 60 with the keys 21 of the body 50 (shown in FIG. 9A-9D), the seal ring 60 is sized to seat on the body rim 22 of the body 50 and form a seal between seal ring 60 and the outer ring 58 of the body 50. When seated on the body rim 22 of the body 50, the seal ring 60 is positioned below the outer plane 34 of the body 36. The vinyl liner 36 is held in place between the inner rim 14 of the clamp ring 10 and the seal ring 60 with a plurality of screw 8, similar to the inner rim 14 holding the vinyl liner 36 in place between the clamp ring 10 and the body rim 22, as described above. As also described above, an outer ring 18 of cover ring 2 coupled to the body 50 covers the screws 8 and inner rim 14 of the clamp ring 10. In this configuration, the inner rim 14 of the clamp ring 10 is positioned below the outer plane 34 of the body 50, an outer rim 18 of the clamp ring 10 is positioned above the outer plane 34 of the body, and the cover rim 4 of the cover ring 2 covers the inner rim 14 and is substantially planar with the outer rim 18 of the clamp ring 10.

Figure 8:
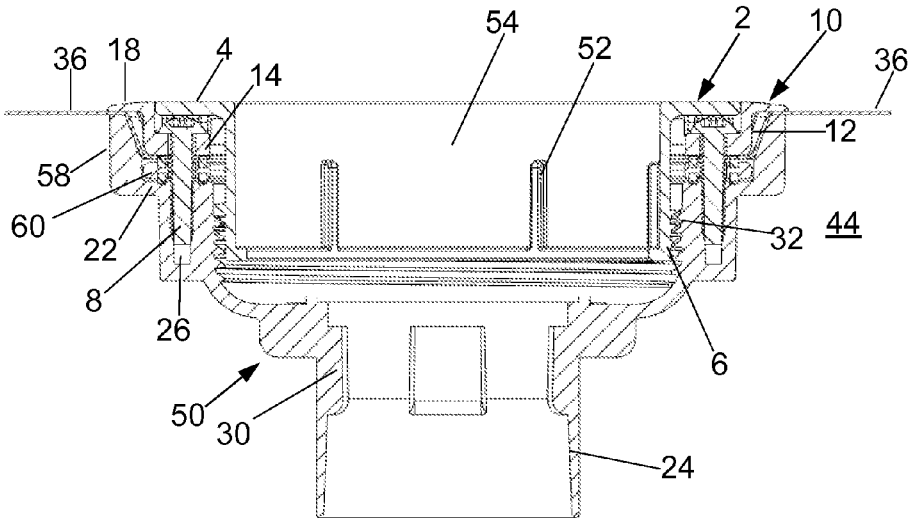
FIG. 8 is a cross-sectional view of a second embodiment of a pool nozzle assembly mounted in a vinyl lined pool taken along line E-E of FIG. 5 with the cleaning nozzle removed.
Figure 9A:
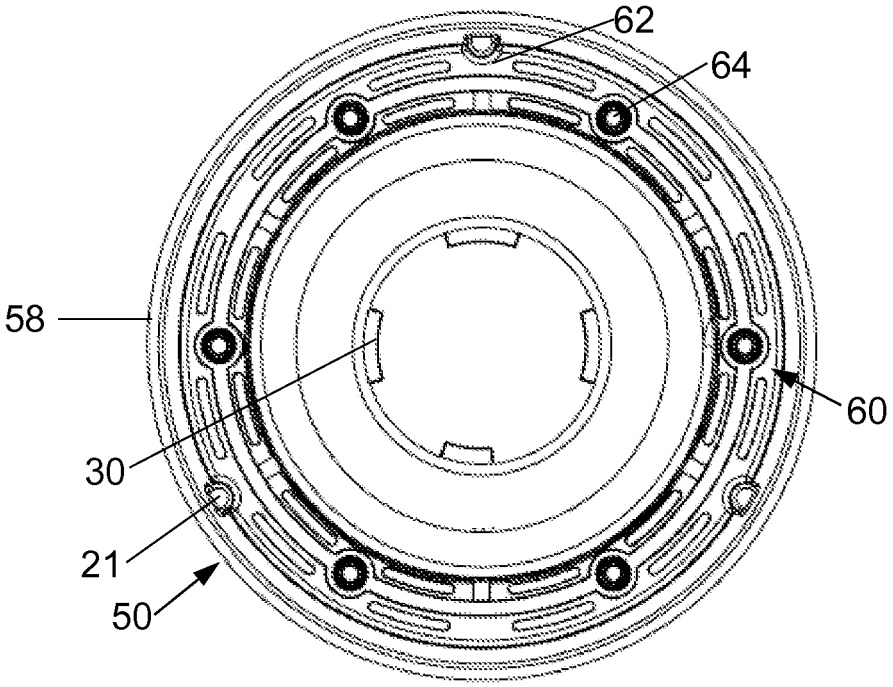
FIG. 9A is a top view of a seal ring seated in a body of a pool nozzle assembly.
Figure 9B:
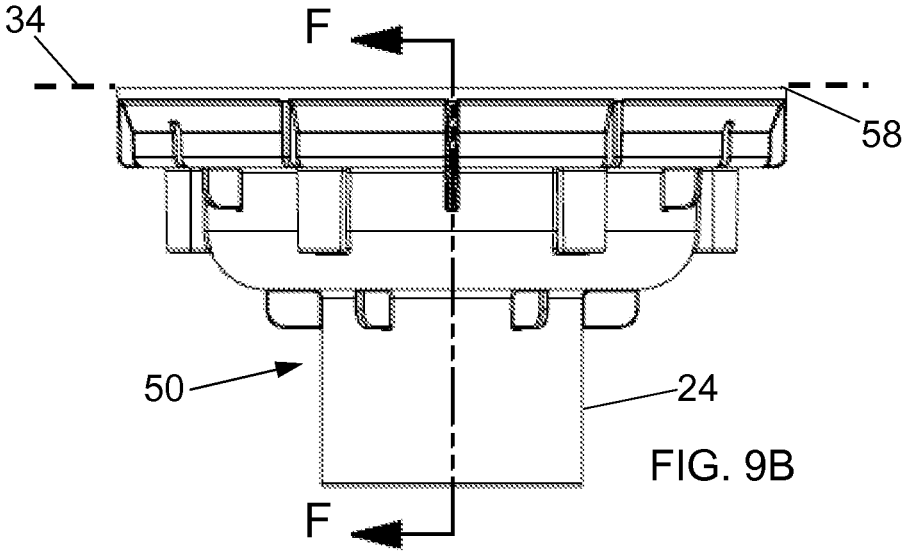
FIG. 9B is a side view of a seal ring seated in a body of a pool nozzle assembly, the seal ring being obscured from view by the body.
Figure 9C:
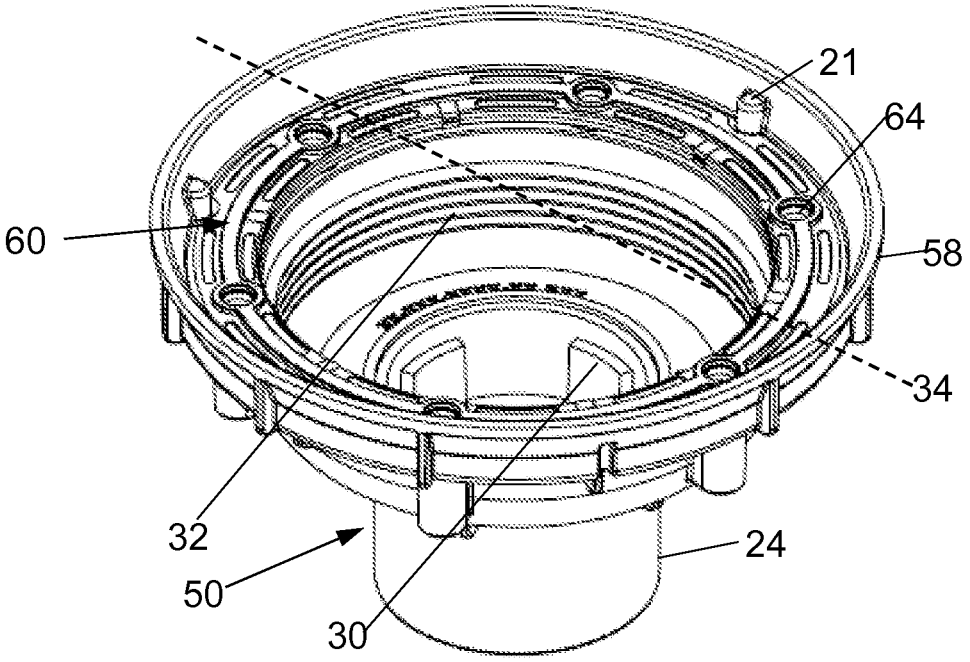
FIG. 9C is a top perspective view of a seal ring seated in a body of a pool nozzle assembly.
Figure 9D:
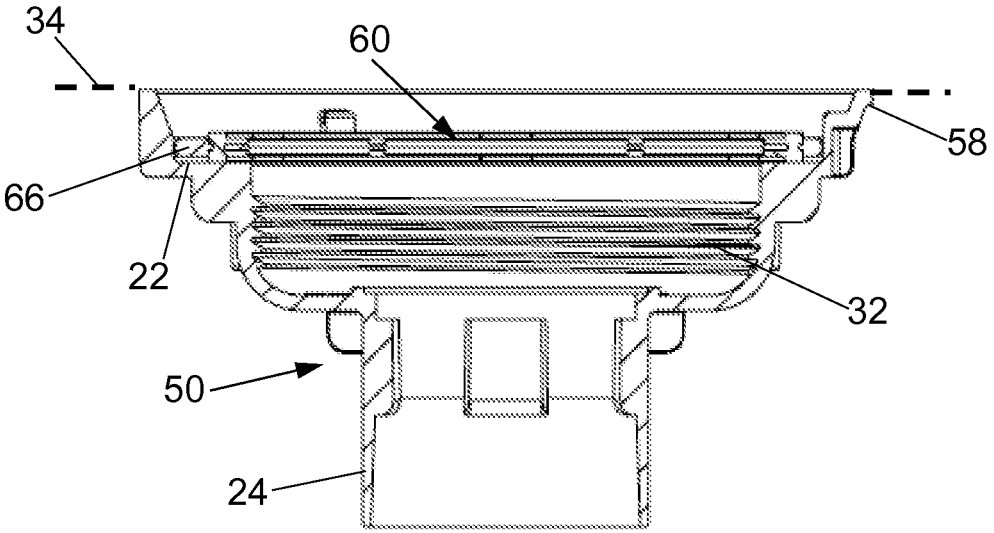
FIG. 9D is a cross-sectional view of a seal ring seated in a body of a pool nozzle assembly taken along line F-F of FIG. 9B.

FIG. 8 depicts a cross-sectional view of a nozzle assembly taken along lined E-E of FIG. 5 with the cleaning nozzle 40 removed. Like other embodiments contemplated in this disclosure, a nozzle assembly comprising a seal ring 60 is configured to allow a user to install or remove a cleaning nozzle 40 without damaging or stressing the vinyl liner 36.

Also contemplated in this disclosure is a two-way installation tool 70. An installation tool may be utilized with a nozzle assembly that includes a sealing ring 60 or does not include a sealing ring 60. According to some aspects, an installation tool is configured to assist in tightening a clamp ring 10 in a clamp ring tightening position and/or configured to assist in tightening a cover ring 2 in a cover ring tightening position. FIGS. 10A-D depict various views of a non-limiting embodiment of an installation tool 70 in a clamp ring tightening position and FIGS. 11A-D depict various views of a non-limiting embodiment of an installation tool 70 in a cover ring tightening position. The exploded view of a non-limiting nozzle assembly depicted in FIG. 7 also includes a perspective view of an installation tool 70, although an installation tool 70 is not required in each embodiment of a nozzle assembly.

According to some aspects, an installation tool 70 comprises a base 80, a head 74, and one or more handles 76. The installation tool 70 may comprise a one-piece, integrally formed or molded installation tool or multiple components coupled together. In some embodiments, the one or more handles 76 comprise two opposing handles 76 extending from the head 74 of the installation tool 70. In other embodiments, however, the handles 76 may extend from the base 80 or comprise other quantities of handles 76.

Figure 10A:
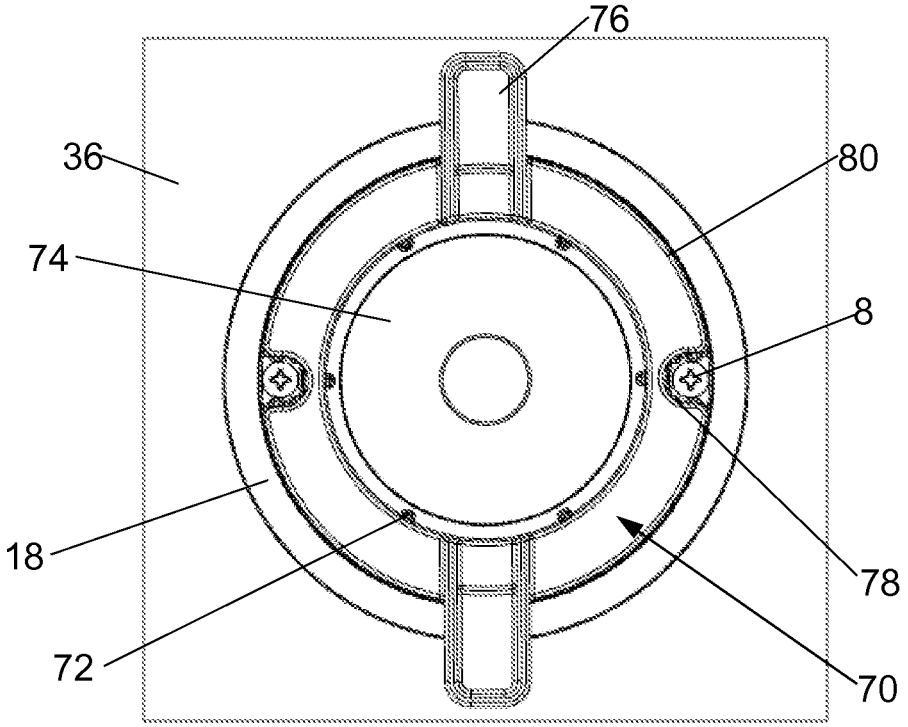
FIG. 10A is a top view of an installation tool in a clamp ring tightening position over a clamp ring, a seal ring, and a body of a pool nozzle assembly.
Figure 10B:
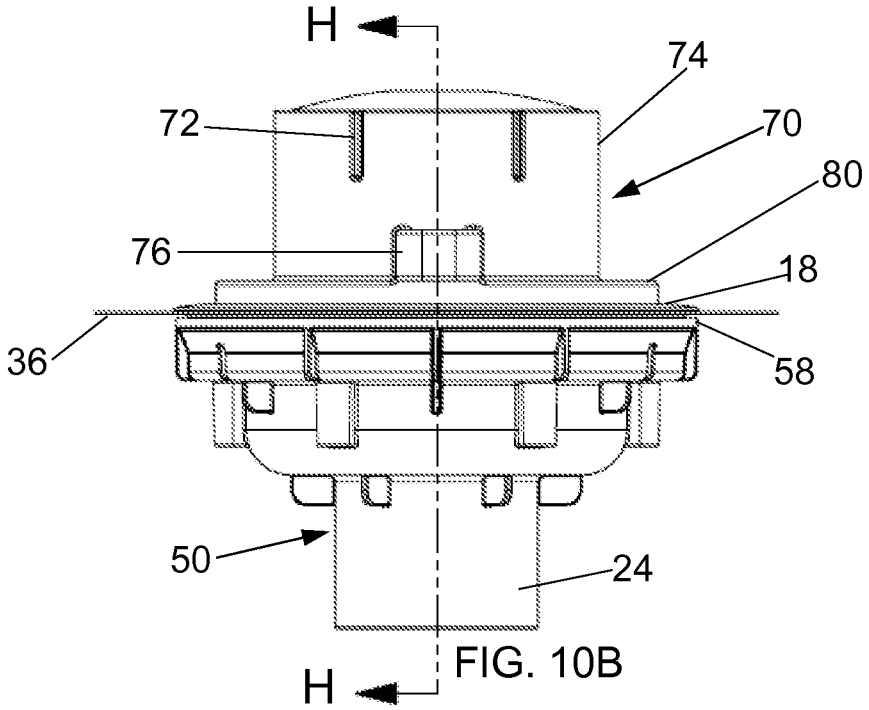
FIG. 10B is a side view of an installation tool in a clamp ring tightening position over a clamp ring, a seal ring, and a body of a pool nozzle assembly.
Figure 10C:
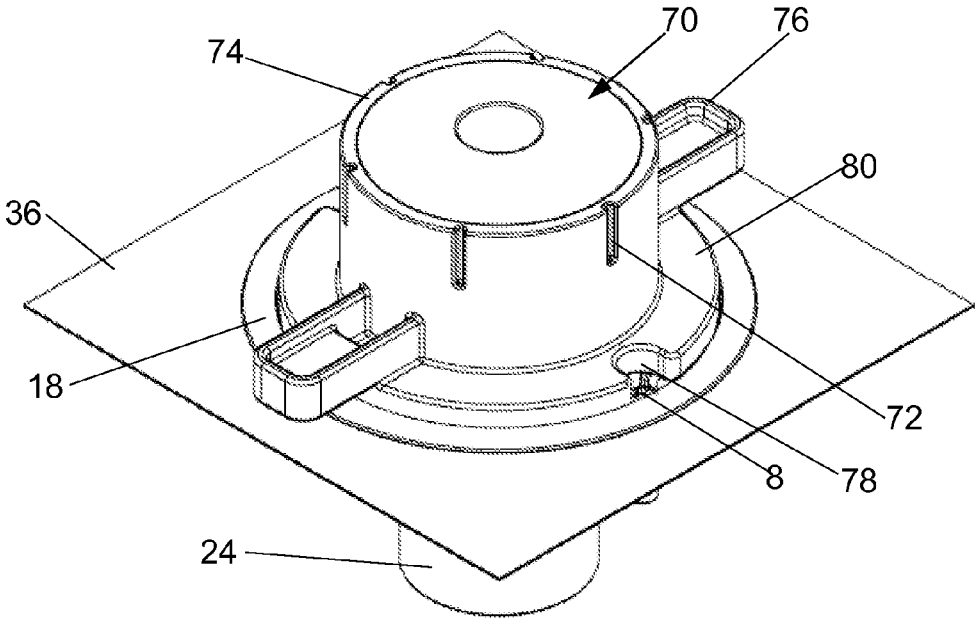
FIG. 10C is a top perspective view of an installation tool in a clamp ring tightening position over a clamp ring, a seal ring, and a body of a pool nozzle assembly.
Figure 10D:
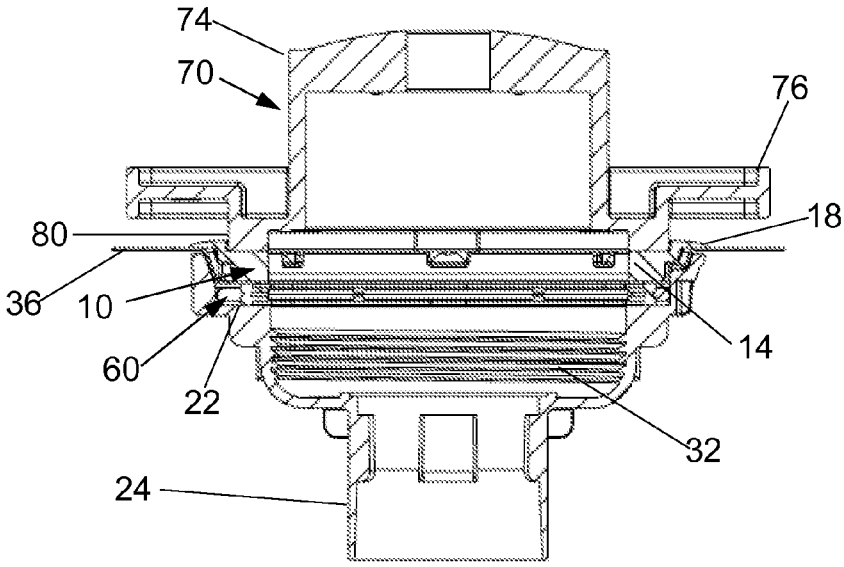
FIG. 10D is a cross-sectional view of an installation tool in a clamp ring tightening position over a clamp ring, a seal ring, and a body of a pool nozzle assembly taken along line H-H of FIG. 10B.
Figure 11A:
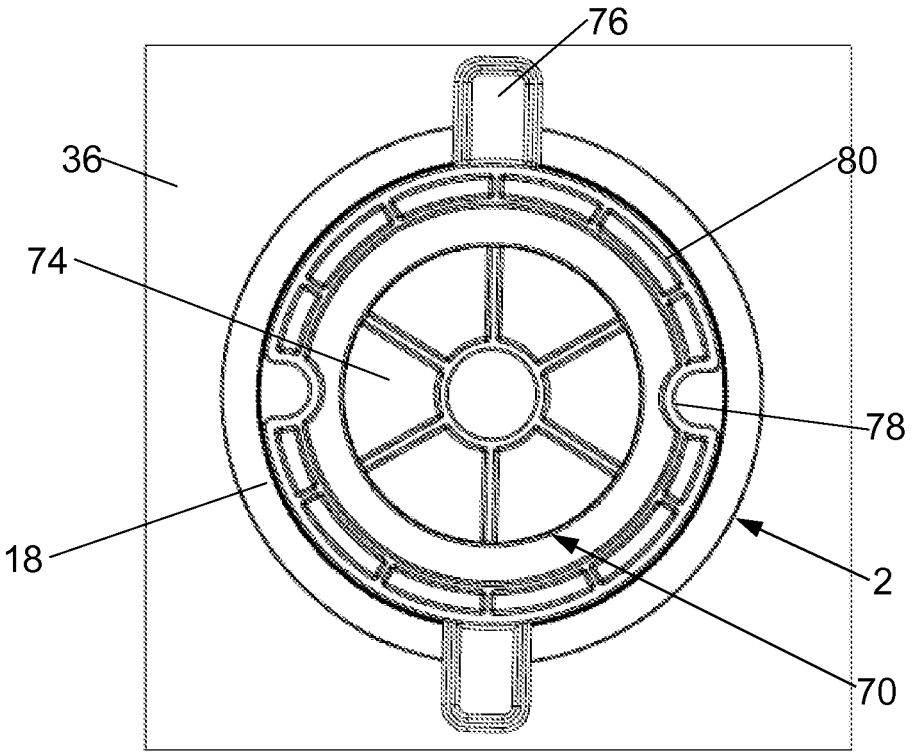
FIG. 11A is a top view of an installation tool in a cover ring tightening position over a cover ring, a clamp ring, a seal ring, and a body of a pool nozzle assembly.
Figure 11B:
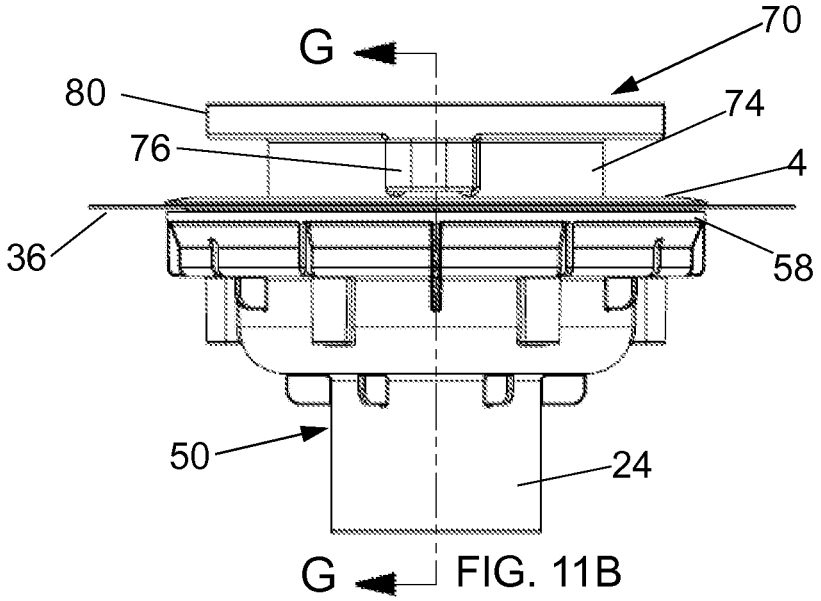
FIG. 11B is a side view of an installation tool in a cover ring tightening position over a cover ring, a clamp ring, a seal ring, and a body of a pool nozzle assembly.
Figure 11C:
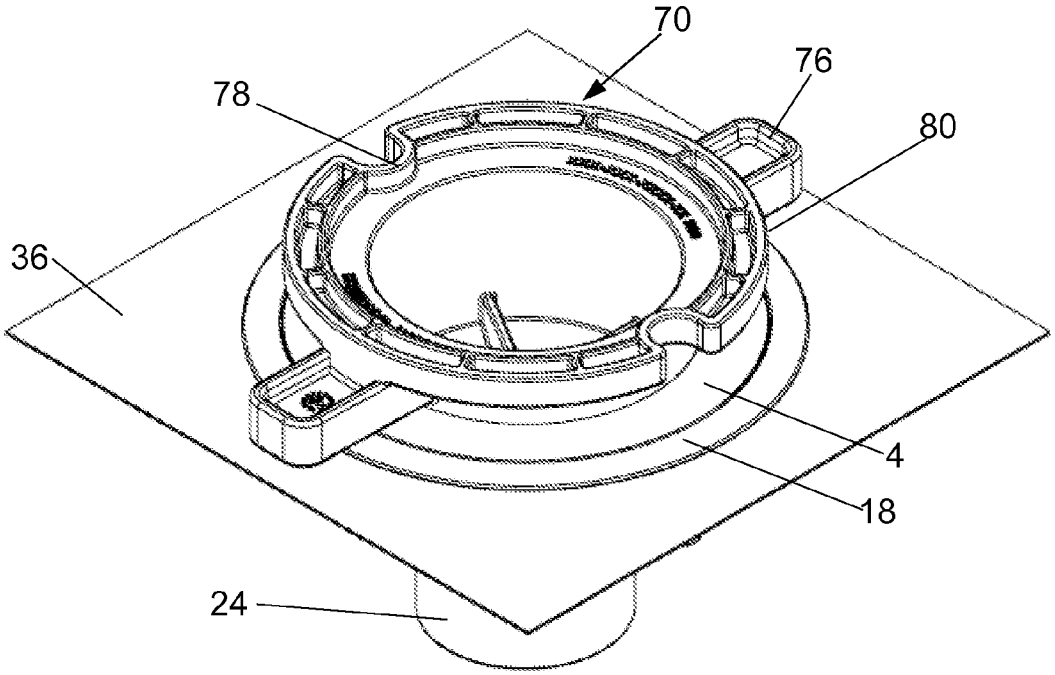
FIG. 11C is a top perspective view of an installation tool in a cover ring tightening position over a cover ring, a clamp ring, a seal ring, and a body of a pool nozzle assembly.
Figure 11D:
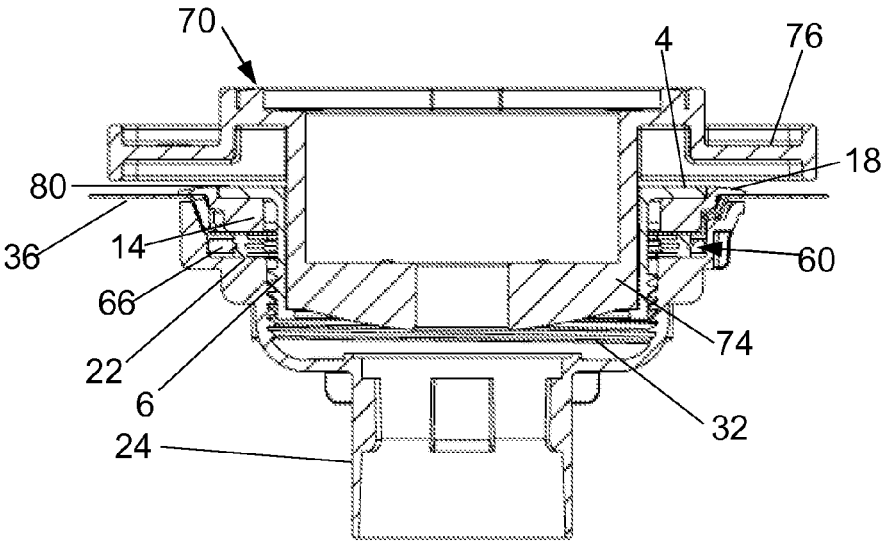
FIG. 11D is a cross-sectional view of an installation tool in a cover ring tightening position over a cover ring, a clamp ring, a seal ring, and a body of a pool nozzle assembly taken along line G-G of FIG. 11B.
Figure 12A:
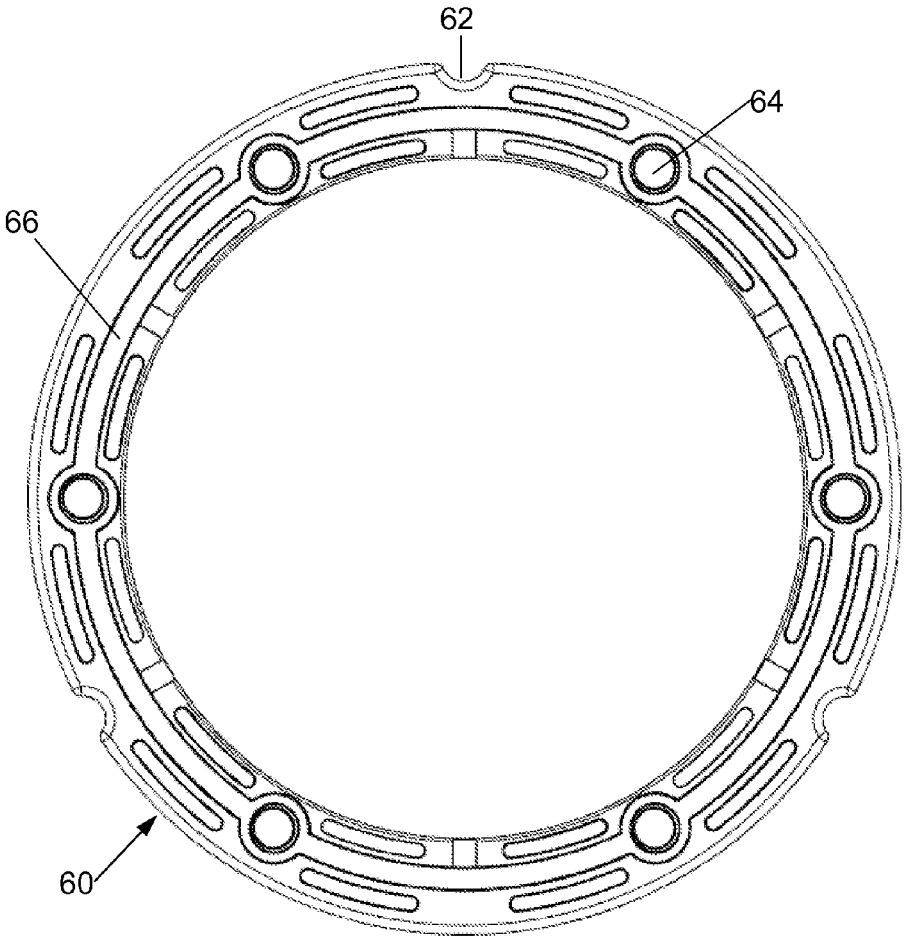
FIG. 12A is a top or bottom view of a seal ring.
Figure 12B:
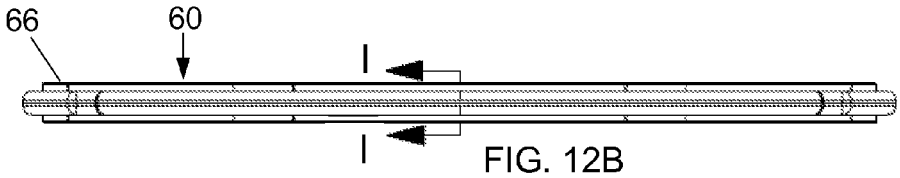
FIG. 12B is a side view of a seal ring.
Figure 12C:
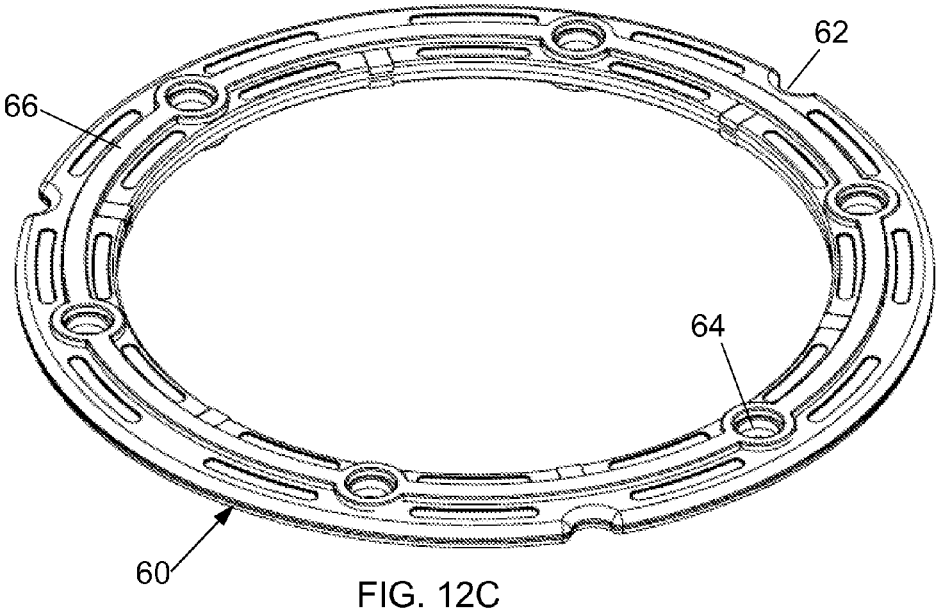
FIG. 12C is a top perspective view of a seal ring.
Figure 12D:
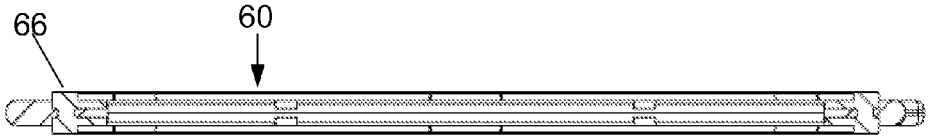
FIG. 12D is a cross-sectional view of a seal ring taken along line I-I of FIG. 12B.

A base 80 of an installation tool 70 may be configured to fit within an outer rim 18 of a clamp ring 10 while seated on an inner rim 14 of the clamp ring 10. According to some aspects, a base 80 of an installation tool is ring-like or circular in shape. FIGS. 10A-D depict a non-limiting embodiment of an installation tool 70 in this, the clamp ring tightening position. In particular, the cross-sectional view of FIG. 10D depicts a base 80 of an installation tool 70 seated within an outer rim 18 and on an inner rim 14 of a clamp ring 10. A base 80 of an installation tool 70 may further comprise one or more screw apertures 78. For example, in the non-limiting embodiment depicted in FIGS. 10A-D, an installation tool 70 comprises two opposing screw apertures 78 positioned to align with two opposing screw holes 16 of the clamp ring 10 and two opposing screw receivers 26 of a body 40, 50. In nozzle assemblies comprising a seal ring, the two opposing screw apertures 78 also align with two opposing screw holes 64 of the seal ring 60. In operation, a user may insert the base 80 of the installation tool 70 within the outer rim 18 and align two screw apertures 78 with two screw holes 16 of the clamp ring 10. A user may then apply pressure to the clamp ring 10 by applying pressure to the head 74 or handles 76 of the installation tool 70. The base 80 then applies a uniform pressure to the clamp ring 10 as the base 80 interfaces the inner rim 14 of the clamp ring 10 due to the circular or ring-like shape of the base 80. In this position, a user may more easily and efficiently insert screws 8 into the screw holes 16 and screw receivers 26.

A head 74 of an installation tool 70 may be sized and shaped to fit within a cover ring 2 of a nozzle assembly. Accordingly, a head 74 may be cylindrical in shape or otherwise complementary in shape to an inner portion 54 of the cover ring 2. In one or more embodiments, a head 74 comprises a plurality of slots 72 positioned to align and engage with a plurality of ribs 52 on an inner portion of the cover ring 2. FIGS. 11A-D depict a non-limiting embodiment of an installation tool 70 with a head 74 inserted into the opening of a cover ring 2. In this, the cover ring tightening position, a plurality of slots 72 on the head 74 of the installation tool 70 engage with a plurality of ribs 52 on the inner portion 54 of the cover ring 2. Engagement of the plurality of slots 72 on the head 74 of the installation tool 70 and the plurality of ribs 52 on the inner portion 54 of the cover ring 2 provides the leverage necessary for a user to rotate and tighten the cover ring 2 by rotating the installation tool 70. As the cover ring 2 rotates responsive to rotation of the installation tool 70, the cover ring 2 tightens against the vinyl liner 36 positioned between the cover ring 2 and either the seal ring 60 or the body rim 22 of the body 40, 50. The handles 76 extending from the head 74 or base 80 of the installation tool 70 allow for easier rotation of the installation tool 70 by a user.

Also contemplated as part of this disclosure is a method of mounting a pool nozzle assembly to a pool having a vinyl liner 36. According to some aspects, the method comprises coupling a body 20 to a water inlet such that an outer ring 28 and an outer plane 34 of the body 20 is substantially flush with a pool base 44. According to some aspects, a method comprises positioning a seal ring 60 within the outer ring 58 of a body 50 and one the body rim 22 of the body 50. In some embodiments, positioning a seal ring within the outer ring 58 of a body 50 comprises inserting one or more keys 21 into one or more indexing guides 62 on the seal ring 60. A method may further comprise aligning a clamp ring 10 with the body 20 by inserting one or more keys 21 on the body 20 into one or more key slots 11 on the clamp ring 10.

A method may further comprise adjustably coupling a recessed inner rim 14 of a clamp ring 10 to a body rim 22 of the body 20 until a vinyl liner 36 is held between the inner rim 14 and either the seal ring 60 or the body rim 22 and between an outer rim 18 of the clamp ring 10 and the outer ring 28 of the body 20. Adjustably coupling an inner rim 14 of a clamp ring 10 to a body rim 22 of the body 20 may comprise adjustably coupling the inner rim 14 of the clamp ring 10 to the body rim 22 of the body 20 with a plurality of screws 8 inserted through a plurality of screw holes 16 on the inner rim 14 of the clamp ring 10 and/or a plurality of screw holes 64 on the seal ring 60 and into a plurality of screw receivers 26 on the body rim 22. According to some aspects, the vinyl liner 36 is cut from the center of the clamp ring 10 before the cover ring 2 is installed. According to some aspects, a method may further comprise inserting a base 80 of an installation tool 70 within the outer rim 18 of the clamp ring 10, aligning at least two screw apertures 78 on the installation tool 70 with at least two screw holes 16 of the plurality of screw holes 16 on the clamp ring 10, and applying a uniform pressure to the clamp ring 10 with the base 80 of the installation tool 70 by pressing the installation tool 70 towards the clamp ring 10. As noted above the size and shape of the base 80 of the installation tool 70 allows the base 80 to interface with nearly all 360 degrees of the inner rim 14, thus providing a uniform pressure around the clamp ring 10.

A method may further comprise adjustably coupling a cover ring 2 to the body 20 by directly and mechanically engaging a first coupling portion of the body 20 with a second coupling portion of the cover ring 2 until a cover rim 4 of the cover ring 2 is substantially planar with the outer rim 18 of the clamp ring 10 and covers the inner rim 14 of the clamp ring 10. Adjustably coupling a cover ring 2 to the body 20 by directly and mechanically engaging a first coupling portion of the body 20 with a second coupling portion of the body 20 may comprise threadedly coupling a female threaded portion 32 of the body 20 with a male threaded portion 6 of the cover ring 2. According to some aspects, a method further comprises aligning two or more slots 72 on a head 74 of the installation tool 70 with two or more ribs 52 on an inner portion 54 of the cover ring 2 and inserting the head 70 of the installation tool 70 into the cover ring 2 such that the two or more slots 72 are engaged with the two or more ribs 52. In such an embodiment, threadedly coupling the female threaded portion 32 of the body 20, 50 with the male threaded portion 6 of the cover ring 2 may comprise threadedly coupling the female threaded portion 32 of the body 20, 50 with the male threaded portion 6 of the cover ring 2 by rotating the installation tool 70.

The method may further comprise inserting a nozzle 40 through the cover ring 4, the vinyl liner 36, and the clamp ring 10 and into the body 20, 50 until a top end 46 of the nozzle is substantially planar with the cover rim 4 and the outer rim 18. Alternatively, the nozzle 40 may be inserted into the nozzle assembly prior to coupling of the cover ring 2 to the body 20, and in particular implementations it may be done before installation of vinyl liner 36. The method may further comprise coupling the nozzle to a base of the body. Coupling the nozzle 40 to the body 20 may comprise coupling the nozzle 40 to a base 24 of the body 20 by engaging bayonets 30 on the base 24 of the body 20 with bayonets 39 on the nozzle 40.

It will be understood that implementations are not limited to the specific components disclosed herein, as virtually any components consistent with the intended operation of a method and/or system implementation for pool nozzle assemblies may be utilized. Accordingly, for example, although particular cleaning nozzles, screws, bodies, clamp rings, and cover rings may be disclosed, such components may comprise any shape, size, style, type, model, version, class, grade, measurement, concentration, material, weight, quantity, and/or the like consistent with the intended operation of a method and/or system implementation for a pool nozzle assembly may be used.

In places where the description above refers to particular implementations of pool nozzle assemblies, it should be readily apparent that a number of modifications may be made without departing from the spirit thereof and that these implementations may be applied to other pool nozzle assemblies. The accompanying claims are intended to cover such modifications as would fall within the true spirit and scope of the disclosure set forth in this document. The presently disclosed implementations are, therefore, to be considered in all respects as illustrative and not restrictive, the scope of the disclosure being indicated by the appended claims rather than the foregoing description. All changes that come within the meaning of and range of equivalency of the claims are intended to be embraced therein.

The invention claimed is:

1. A pool nozzle assembly, comprising:

a body comprising a first coupling portion and a body rim comprising a plurality of screw receivers;

a seal ring coupled to the body rim of the body and comprising an integrated seal;

a clamp ring removably and adjustably coupled to the body and configured to couple a vinyl liner between the clamp ring and the seal ring and position the vinyl liner below an outer plane of the body, the clamp ring comprising a plurality of screw holes extending through a recessed inner rim of the clamp ring, the plurality of clamp ring screw holes aligned with the plurality of screw receivers of the body;

a plurality of screws extending through the plurality of screw holes into the plurality of screw receivers to removably couple the clamp ring to the body; and a cover ring comprising a second coupling portion directly and mechanically engaged with the first coupling portion, and a cover rim extending radially outward over the plurality of screws.

2. The pool nozzle assembly of claim 1, wherein the seal ring comprises at least one indexing guide engaged with at least one key on the body.

3. The pool nozzle assembly of claim 1, wherein the clamp ring is removably coupled to the body below the outer plane of the body and comprises an outer rim positioned above the outer plane of the body, and wherein the cover ring is substantially planar with the outer rim of the clamp ring.

4. The pool nozzle assembly of claim 2, wherein the first coupling portion comprises a female threaded portion and the second coupling portion comprises a male threaded portion threadedly coupled to the female threaded portion.

5. The pool nozzle assembly of claim 2, wherein the seal ring comprises a plurality of screw holes aligned with the plurality of screw receivers, and the clamp ring and the seal ring are removably and adjustably coupled to the body with the plurality of screws extending through the screw holes of the seal ring and the screw holes of the inner rim and into the screw receivers.

6. The pool nozzle assembly of claim 5, wherein the cover ring comprises at least two ribs on an inner portion of the cover ring, and the pool nozzle assembly further comprises an installation tool comprising:

a base sized to fit within the outer rim of the clamp ring and interface with the inner rim of the clamp ring;

at least one opposing screw apertures positioned to align with at least one of the plurality of screw holes on the clamp ring when the base of the installation tool is positioned within the outer rim of the clamp ring;

a head sized to fit within the inner portion of the cover ring and comprising at least two slots sized and positioned to engage with the at least two ribs on the inner portion of the cover ring when the head of the installation tool is positioned within the inner portion of the cover ring; and one or more handles.

7. The pool nozzle assembly of claim 5, wherein the body further comprises a base having a plurality of bayonets and a plurality of keys, and the clamp ring comprises a plurality of key slots engaged with the plurality of keys.

8. The pool nozzle assembly of claim 7, further comprising a nozzle removably coupled to the base of the body such that a top end of the nozzle is substantially planar with the outer rim and the cover rim.

9. A pool nozzle assembly, comprising:

a body comprising a body rim positioned below an outer plane of the body;

a seal ring coupled to the body adjacent the body rim;

a clamp ring coupled to the body and configured to couple a vinyl liner between the clamp ring and the seal ring;

a cover ring directly coupled to the body and comprising a cover rim;

a nozzle removably coupled to the body such that a top end of the nozzle is substantially planar with the cover rim of the cover ring; wherein:

the body comprises a base configured to couple to a water line coupling, a body rim comprising a plurality of screw receivers, and a first coupling portion between the body rim and the base;

the seal ring comprises an integrated seal and a plurality of screw holes extending through the seal ring and aligned with the plurality of screw receivers of the body;

the clamp ring comprises a recessed inner rim, a plurality of screw holes extending through the recessed inner rim and aligned with the plurality of screw receivers of the body, and an outer rim, a plurality of screws extending through the plurality of screw holes into the plurality of screw receivers to removably couple the clamp ring and the seal ring to the body;

the cover ring further comprises a second coupling portion directly and mechanically engaged with the first coupling portion of the body, wherein the cover rim of the cover ring covers the plurality of screws and is substantially planar with the outer rim of the clamp ring; and the nozzle is removably coupled to the base of the body such that the top end of the nozzle is substantially planar with both the outer rim and the cover rim.

10. The pool nozzle assembly of claim 9, wherein the seal ring comprises at least one indexing guide engaged with at least one key on the body.

11. The pool nozzle assembly of claim 9, wherein the base further comprises one or more bayonets that engage with one or bayonets on the nozzle to removably couple the nozzle to the body and one or more keys, and the clamp ring comprises one or more key slots aligned with and interfacing the one or more keys.

12. The pool nozzle assembly of claim 9, wherein the cover ring comprises at least two ribs on an inner portion of the cover ring, and the pool nozzle assembly further comprises an installation tool comprising:

a base sized to fit within the outer rim of the clamp ring and interface with the inner rim of the clamp ring;

one or more opposing screw apertures positioned to align with one or more of the plurality of screw holes on the clamp ring when the base of the installation tool is positioned within the outer rim of the clamp ring;

a head sized to fit within the inner portion of the cover ring and comprising at least two slots sized and positioned to engage with the at least two ribs on the inner portion of the cover ring when the head of the installation tool is positioned within the inner portion of the cover ring; and one or more handles.

* * * * *